US006648697B2

(12) United States Patent
Yang

(10) Patent No.: US 6,648,697 B2
(45) Date of Patent: Nov. 18, 2003

(54) CONNECTOR

(75) Inventor: Rick Yang, Taipei (TW)

(73) Assignee: All Best Electronics Co., Ltd., Taipei (TW)

( * ) Notice: Subject to any disclaimer, the term of this patent is extended or adjusted under 35 U.S.C. 154(b) by 0 days.

(21) Appl. No.: 10/122,225

(22) Filed: Apr. 16, 2002

(65) Prior Publication Data

US 2003/0194915 A1 Oct. 16, 2003

(51) Int. Cl.[7] ..... H01R 13/502
(52) U.S. Cl. ..... 439/701; 439/752; 439/942
(58) Field of Search ..... 439/752, 492, 439/499, 701, 942, 660, 78, 80

(56) References Cited

U.S. PATENT DOCUMENTS 5,975,917 A * 11/1999 Wang et al. ..... 439/79
6,039,611 A * 3/2000 Yang ..... 439/701
6,129,594 A * 10/2000 Lai ..... 439/701
6,159,040 A * 12/2000 Chang et al. ..... 439/541.5
6,354,886 B1 * 3/2002 Yu ..... 439/701

* cited by examiner

*Primary Examiner*—Hien Vu
(74) *Attorney, Agent, or Firm*—Rabin & Berdo, P.C.

(57) ABSTRACT

A connector includes a plastic body having a metal case put over an outer portion of a front end thereof, an insertion plate connected to a rear end of the plastic body, an interconnecting cable including two rows of conducting wires separately set onto upper rear and lower rear sides of the insertion plate, and two covering plates separately covered onto upper and lower sides of the insertion plate to hold the conducting wire of the interconnecting cable in place and then integrally connected to the insertion plate by way of high-frequency heat sealing. The plastic body, the insertion plate, and the covering plates are provided at predetermined positions with slots for receiving isolation plates therein, so that terminals inserted in the plastic body are individually surrounded by the isolation plates to eliminate mutual interference and therefore enable stable transmission of signals at high speed.

3 Claims, 13 Drawing Sheets

A–A'

A-A

B-B

CONNECTOR

BACKGROUND OF THE INVENTION

The present invention relates to a connector, and more particularly to a connector having individually isolated terminals to eliminate mutual interference between the terminals during high-speed signal transmission and therefore enable faster and more stable transmission of signals.

With the increasingly developed technologies, computers have been designed to provide incredibly powerful functions. That is, the central processing unit (CPU) inside each computer has a higher operation capability than ever. Meanwhile, the Internet has become so popular that upload uploading and downloading at extremely high speed speeds, via wide-band optical fibers, asymmetric digital subscriber line (ADSL) and the like has been developed in response to user demands. Thus, peripheral Active/passive components for using the Internet must be matched to the high operating speeds. A cable for transmitting signals between the CPU of a computer and the Active/passive components is therefore particularly important, and connectors at two ends of the cable are responsible for successful high-speed signal transmission.

FIGS. 1 and 2 are exploded and partially assembled perspective views, respectively, of a conventional connector. As shown, the conventional connector includes a metal case 4, a plastic body 1, an insertion plate 2, two hold-down plates 3. The metal case 4 is put onto an outer portion of a front end of the plastic body 1, and insertion plate 2 is connected to the rear end of the plastic body 1.

Two rows of staggered terminals 11 are provided at upper and lower sides of the plastic body 1. The plastic body 1 includes two rearwardly extended lateral walls 12, inner surfaces of which are provided with two guide ways 13. Each guideway 13 has a retaining hole 14 provided therein, such that the insertion plate 2 can be connected to a rear side of the plastic body 1 by sliding it into the guide ways 13. Moreover, the two lateral walls 12 have two vertically extended insertion slots 15 symmetrically provided at their inner surfaces.

The insertion plate 2 is provided at two lateral sides with two retaining projections 22 for engaging with the retaining holes 14 in the guide ways 13 on the plastic body 1, so as to hold the insertion plate 2 to the rear side of the plastic body 1. The insertion plate 2 is also provided at its upper and lower surfaces with a plurality of terminal slots 21 corresponding to the terminals 11. When the insertion plate 2 is connected to the rear side of the plastic body 1, rear ends of the terminals 11 are located in corresponding terminal slots 21 on the insertion plate 2. Rear ends of the terminal slots 21 are spaced from one another with spacing ribs 23. Middle portions of the spacing ribs 23 at both upper and lower sides of the insertion plate 2 are cut away to provide two transversely extended recesses 24. And, two vertically extended slots 25 are provided at two lateral sides of the insertion plate 2 corresponding to the insertion slots 15 on the plastic body 1.

Each of the hold-down plates 3 is provided at middle points of two lateral sides with two projections 31. The hold-down plates 3 are provided at a front part of one side facing the insertion plate 2 with a plurality of hold-down ribs 32 corresponding to and adapted to be located in the terminal slots 21. The projections 31 may be vertically guided into the insertion slots 15 to connect the hold-down plates 3 to the plastic body 1 and to be separately located at upper and lower sides of the insertion plate 2.

Each of the interconnecting cables 5 includes a plurality of conducting wire 51 that are arranged in a predetermined manner corresponding to the terminals 11, and a transverse clamp plate 53 holding the previously arranged conducting wire 51 in place. A fixed length of front ends of the conducting wire 51 is extended from a front side of the clamp plate 53 to expose a fixed length of bare wires 52.

To assemble the above-described conventional connector, the insertion plate 2 is first connected to the rear side of the plastic body 1, and then G the clamp plates 53 of the cables 5 are set in the recesses 24 at upper and lower sides of the insertion plate 2, as shown in FIG. 2, such that the conducting wires 51 are separately located in and between two adjacent spacing ribs 23 with the bare wires 52 pressed against rear ends of corresponding terminals 11. Thereafter, the two hold-down plates 3 are connected to the plastic body 1 to be separately located at upper and lower sides of the insertion plate 2, by guiding the projections 31 into the insertion slots 15 to engage with the slots 25. After the hold-down plates 3 are held in place, the pressed ribs 32 provided at the front part of the hold-down plates 3 are separately located in corresponding terminal slots 21. Finally, rear parts of the hold-down plates 3 are integrally connected to tops of the spacing ribs 23, and the pressed ribs 32 at the front parts of the hold-down plates 3 are integrally connected at two lateral sides to two lateral sides of corresponding terminal slots 21 by way of high-frequency heat sealing, as shown in FIG. 3. The metal case 4 is then put onto the of front end of the plastic body 1 to complete the connector.

Please refer to FIG. 4. This figure is a sectional view taken along line A–A' of FIG. 3. After the rear parts of the hold-down plates 3 are integrally connected to the tops of the spacing ribs 23, and the pressed ribs 32 at the front parts of the hold-down plates 3 are integrally connected at two lateral sides to two lateral sides of corresponding terminal slots 21, the bare wires 52 are separately located in individual terminal slots 21 to tightly contact with rear ends of corresponding terminals 11, such that short circuit at joints of the bare wires 52 and the terminals 11 can be eliminated.

The following disadvantages are found in the above-described conventional connector:

1. When signals are transmitted at high speed via the closely arranged terminals, electric energy on the terminals produces radiation resulting in mutual interference of the terminals with one another and accordingly slow and unstable signal transmission.
2. During high-speed transmission, electric energy on the connector produces radiation to form noise or crosstalk that interferes with other terminals, resulting in a poor signal transmission.
3. The terminals might have static electricity surrounded them due to external factors that affect the connector. Such static electricity forms an interference source in the signal transmission.

It is therefore desirable to develop an improved connector having individually isolated terminals to eliminate mutual interference of terminals with one another during high-speed signal transmission and enable faster and more stable transmission of signals.

SUMMARY OF THE INVENTION

A primary object of the present invention is to provide a connector having individually isolated terminals, so that the terminals do not mutually interfere with one another during high-speed signal transmission, in order to enable faster and more stable transmission of signals.

Another object of the present invention is to provide a connector that has reduced noise or crosstalk produced during high-speed transmission, so that signals-can be more stably transmitted.

A further object of the present invention is to provide a connector that eliminates static electricity possibly produced around terminals and therefore prevents the signal transmission from being interfered by static electricity.

To achieve the above and other objects, the connector of the present invention mainly includes a plastic body having a steel case put over a front end thereof, an insertion plate connected to a rear end of the plastic body, an interconnecting cable including two rows of conducting wire separately set onto upper rear and lower rear sides of the insertion plate, and two covering plates separately covered onto upper and lower sides of the insertion plate to hold the conducting wire of the interconnecting cable in place and then integrally connected to the insertion plate by way of high-frequency heat sealing. The plastic body, the insertion plate, and the covering plates are provided at predetermined positions with slots for receiving metal isolation plates therein, so that terminals on the plastic body are individually surrounded by the isolation plates to eliminate mutual interference and therefore enable stable transmission of signals at high speed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
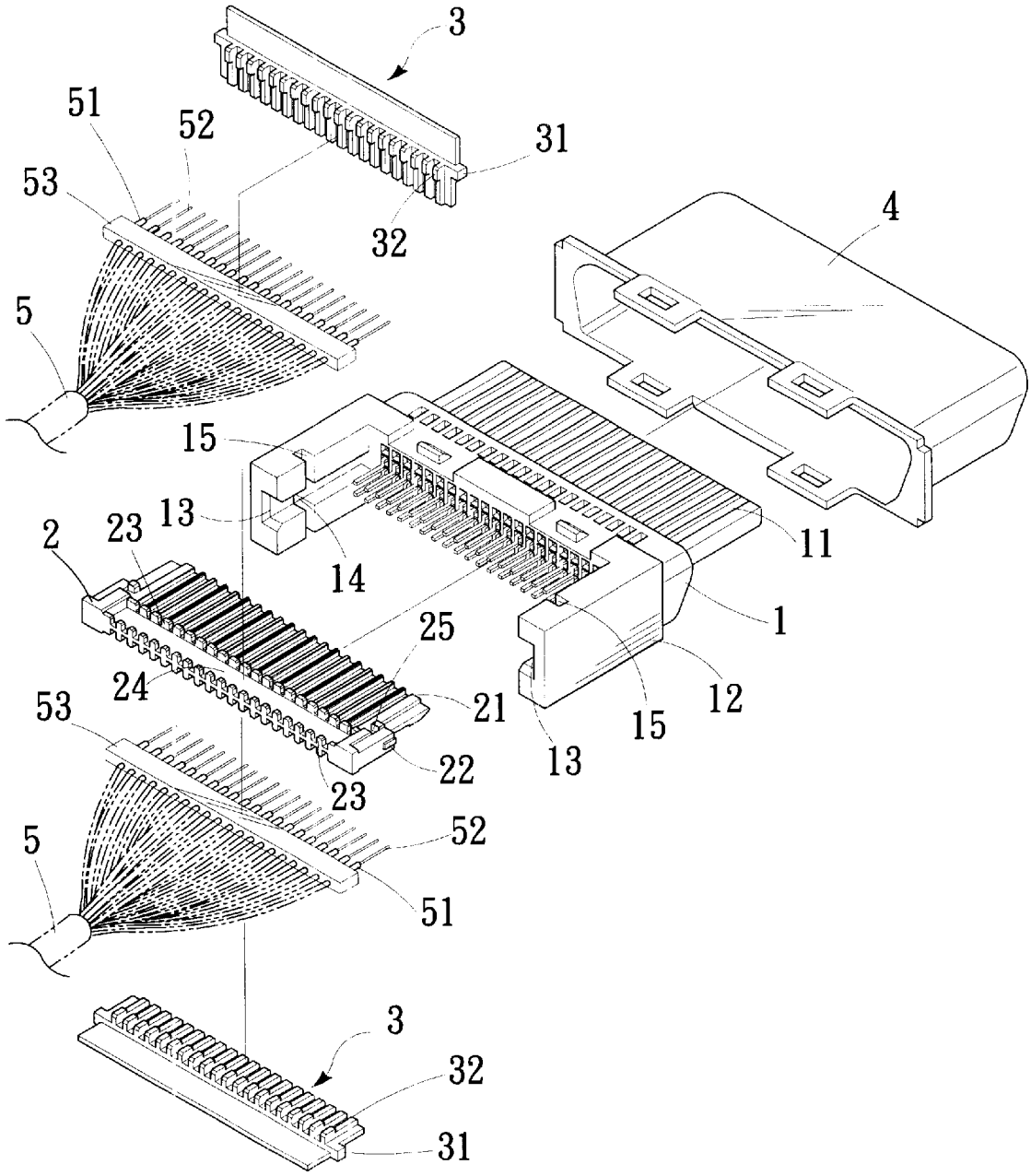
(PRIOR ART) Fig. 1
FIG. 1 is an exploded perspective view of a conventional connector.
Figure 2:
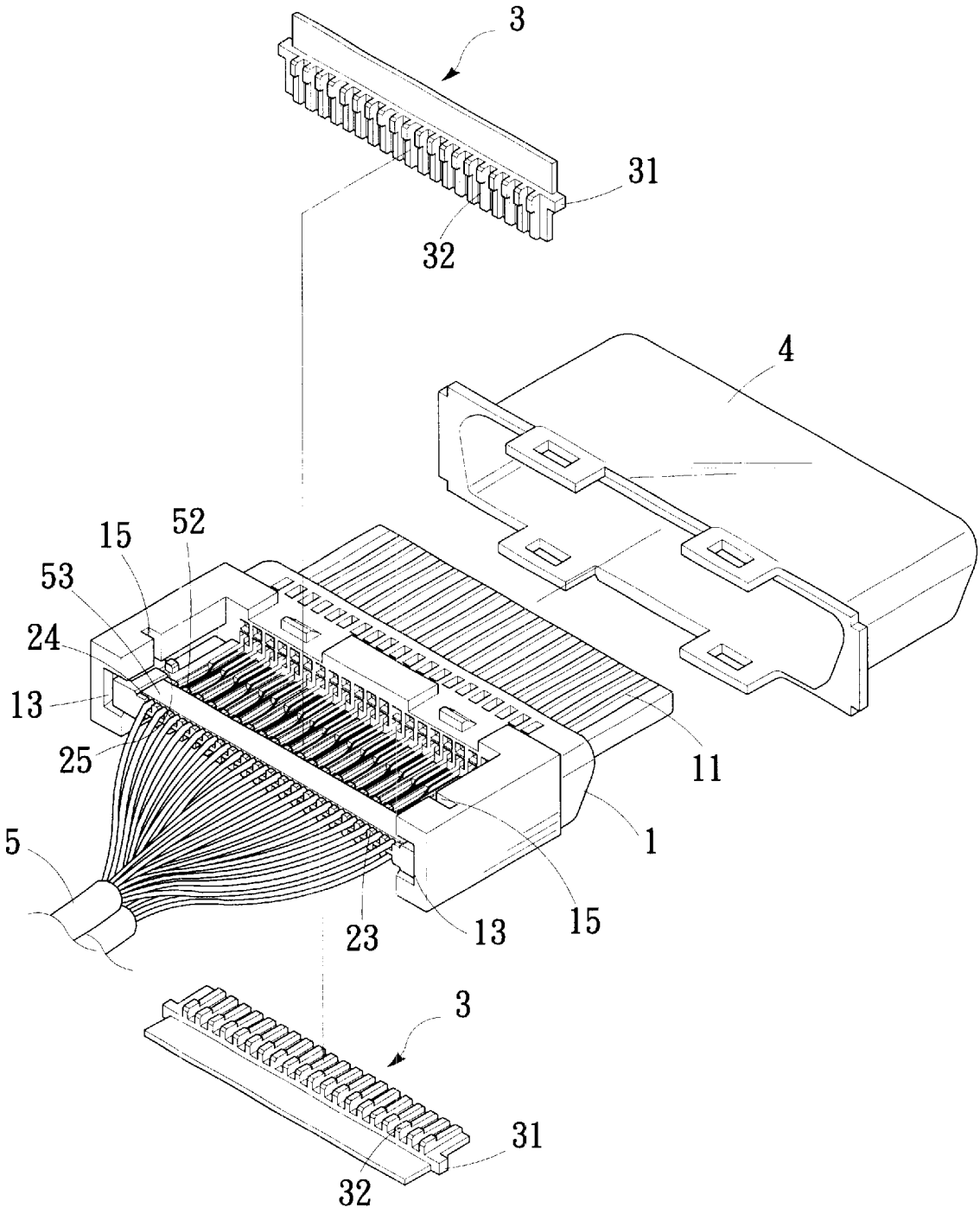
(PRIOR ART) Fig. 2
FIG. 2 is a partially assembled perspective view of the connector of FIG. 1 before two hold-down plates are covered onto the connector.
Figure 3:
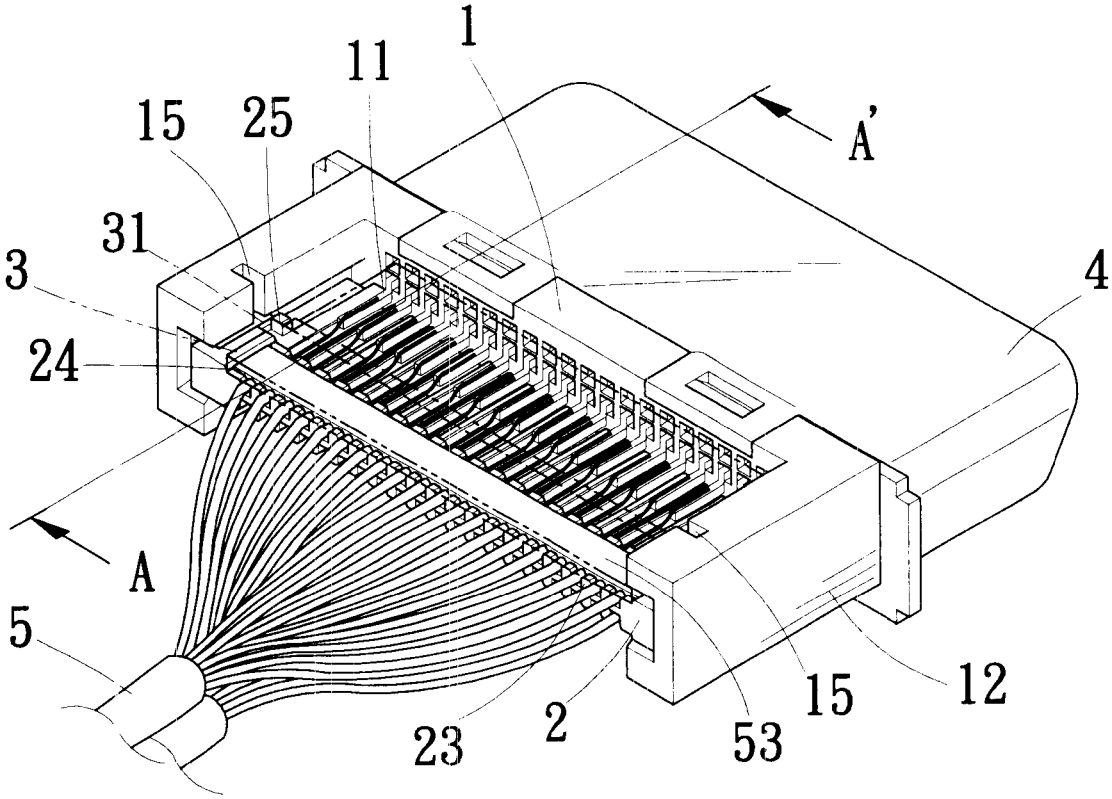
(PRIOR ART) Fig. 3
FIG. 3 is a fully assembled perspective view of the connector of FIG. 1.
Figure 4:
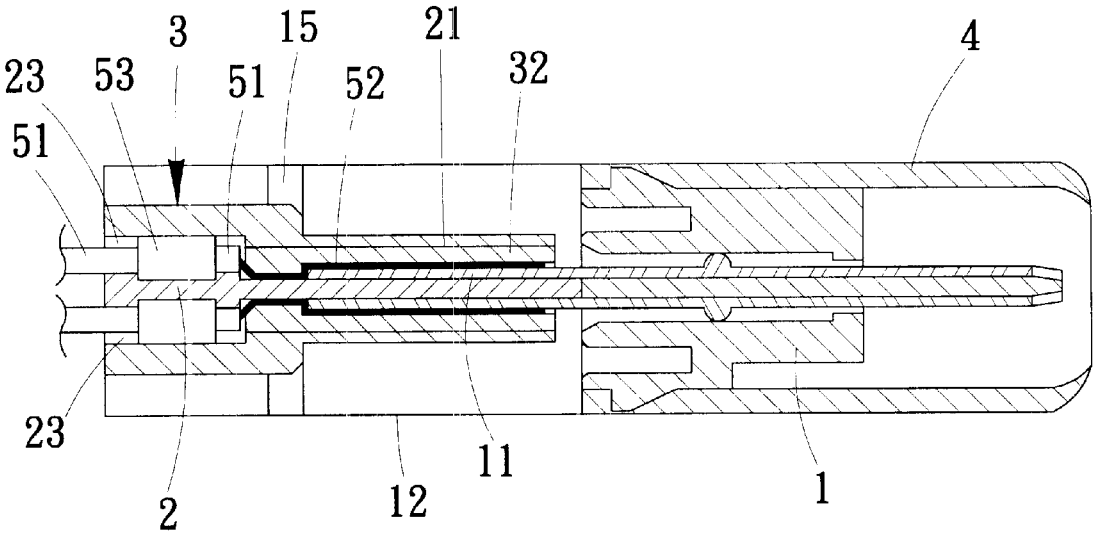
(PRIOR ART) Fig. 4
FIG. 4 is a sectional view taken along line A–A' of FIG. 3.
Figure 5:
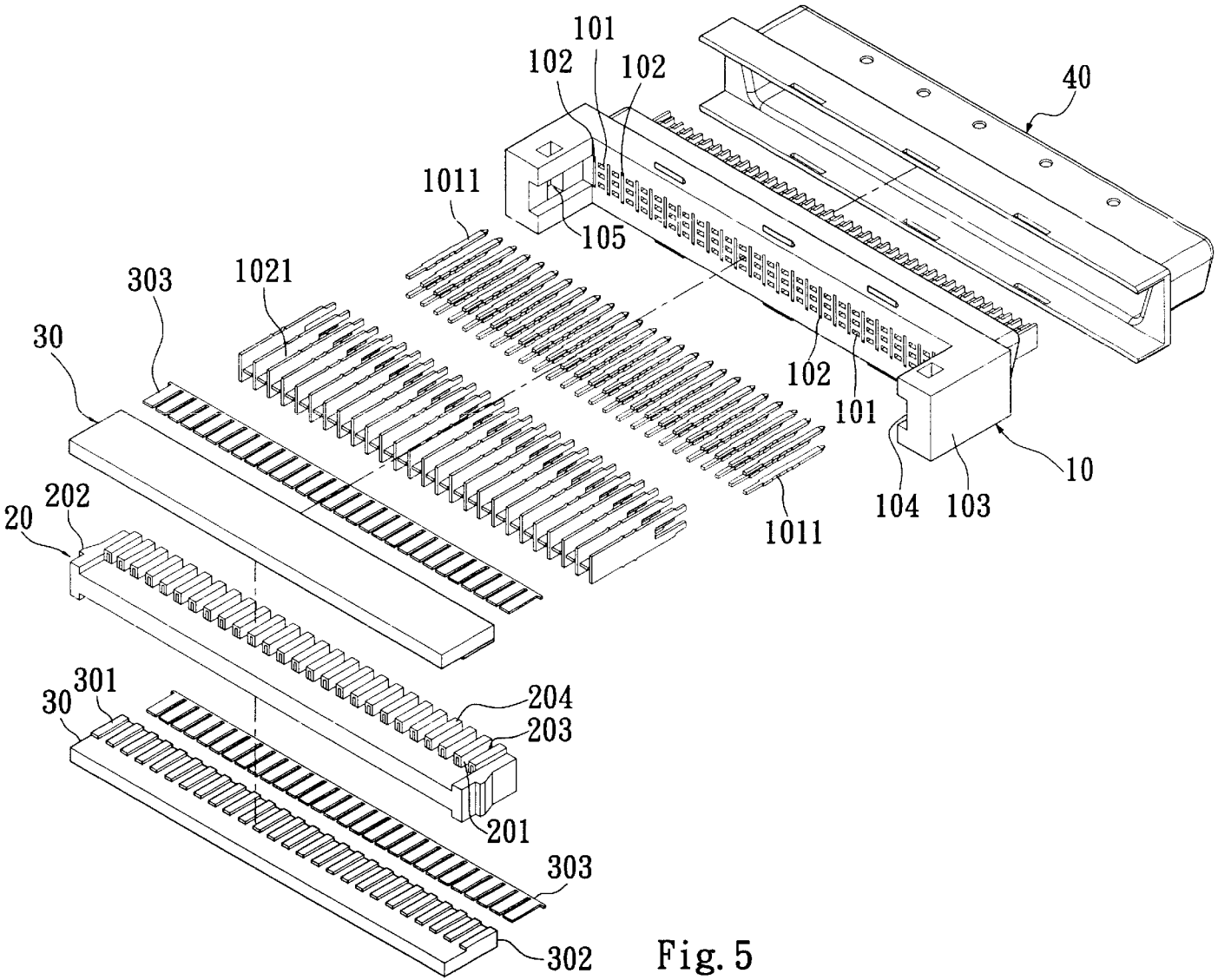
FIG. 5 is an exploded perspective view of a connector according to the present invention.
Figure 6:
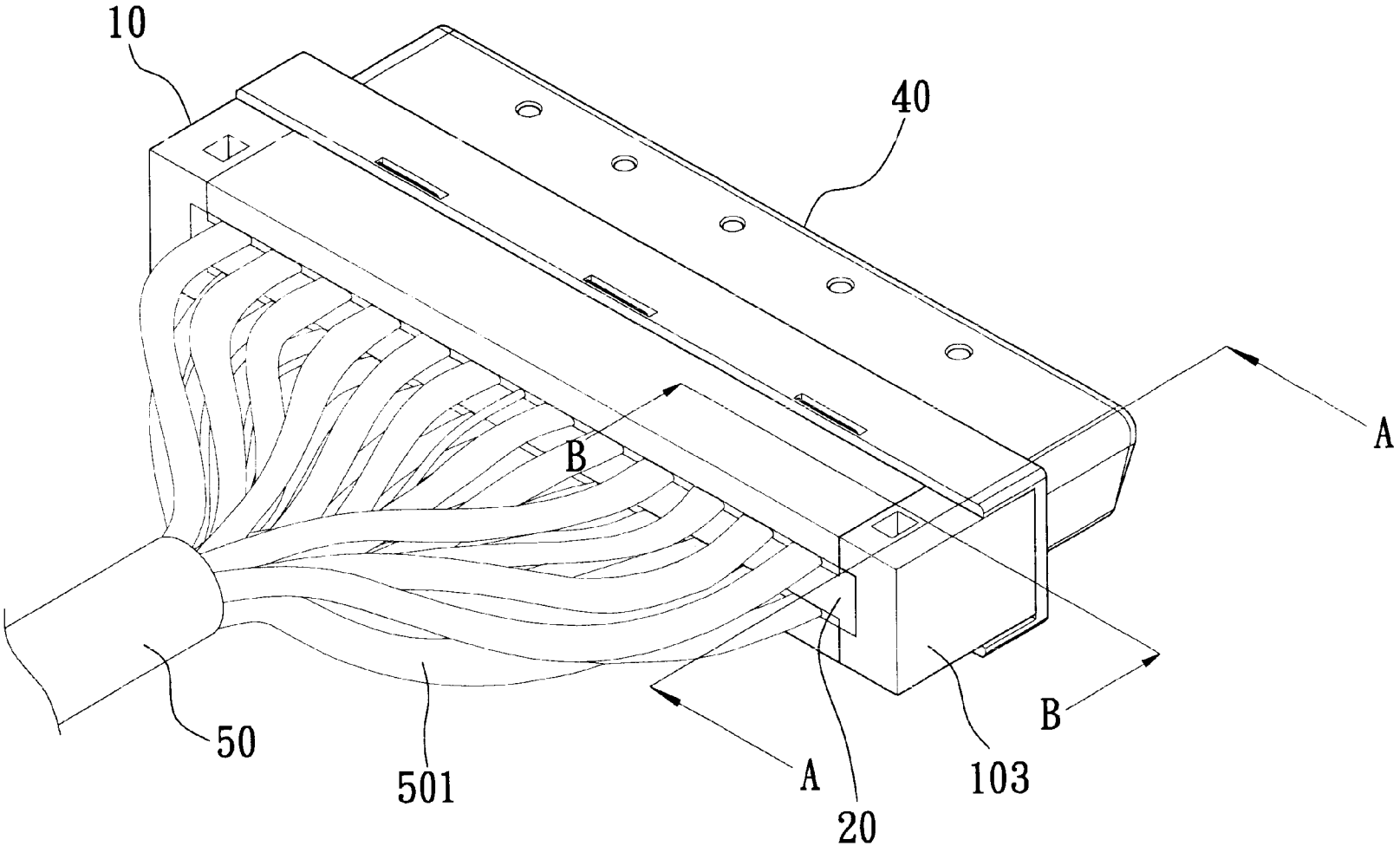
FIG. 6 is an assembled perspective view of the connector of FIG. 5.

Please refer to FIGS. 5 and 6 that are exploded and assembled perspective views, respectively, of a connector according to the present invention. As shown, the connector includes a plastic body 10, an insertion plate 20, two covering plates 30, a metal case 40, and interconnecting cables 50. The case 40 is connected to and covers an outer portion of a front side of the plastic body 10, and the insertion plate 20 is assembled to a rear side of the plastic body 10.

Figure 7:
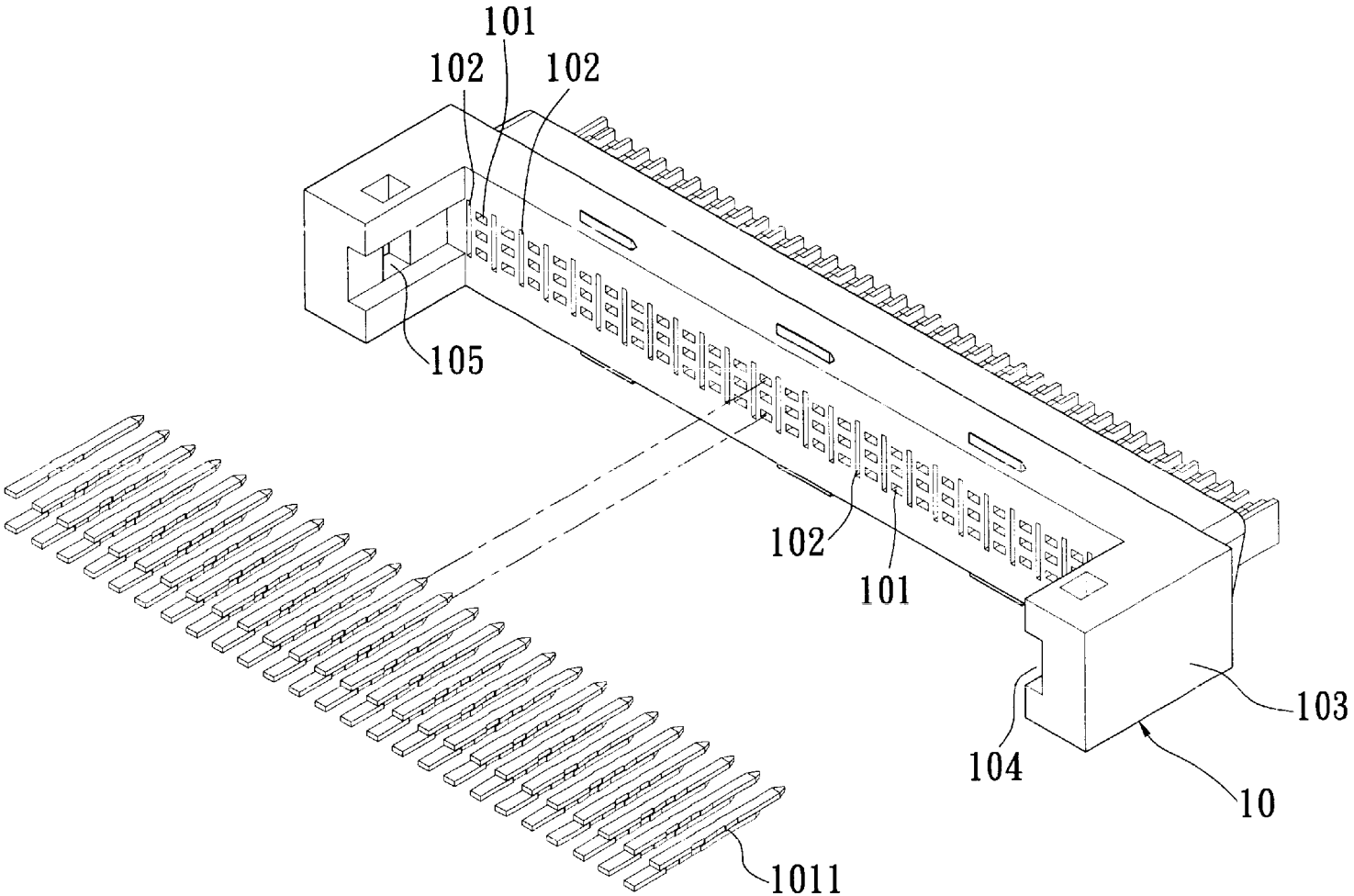
FIG. 7 shows the first step of assembling the connector of the present invention by inserting terminals into terminal slots provided on a plastic body of the connector.
Figure 8:
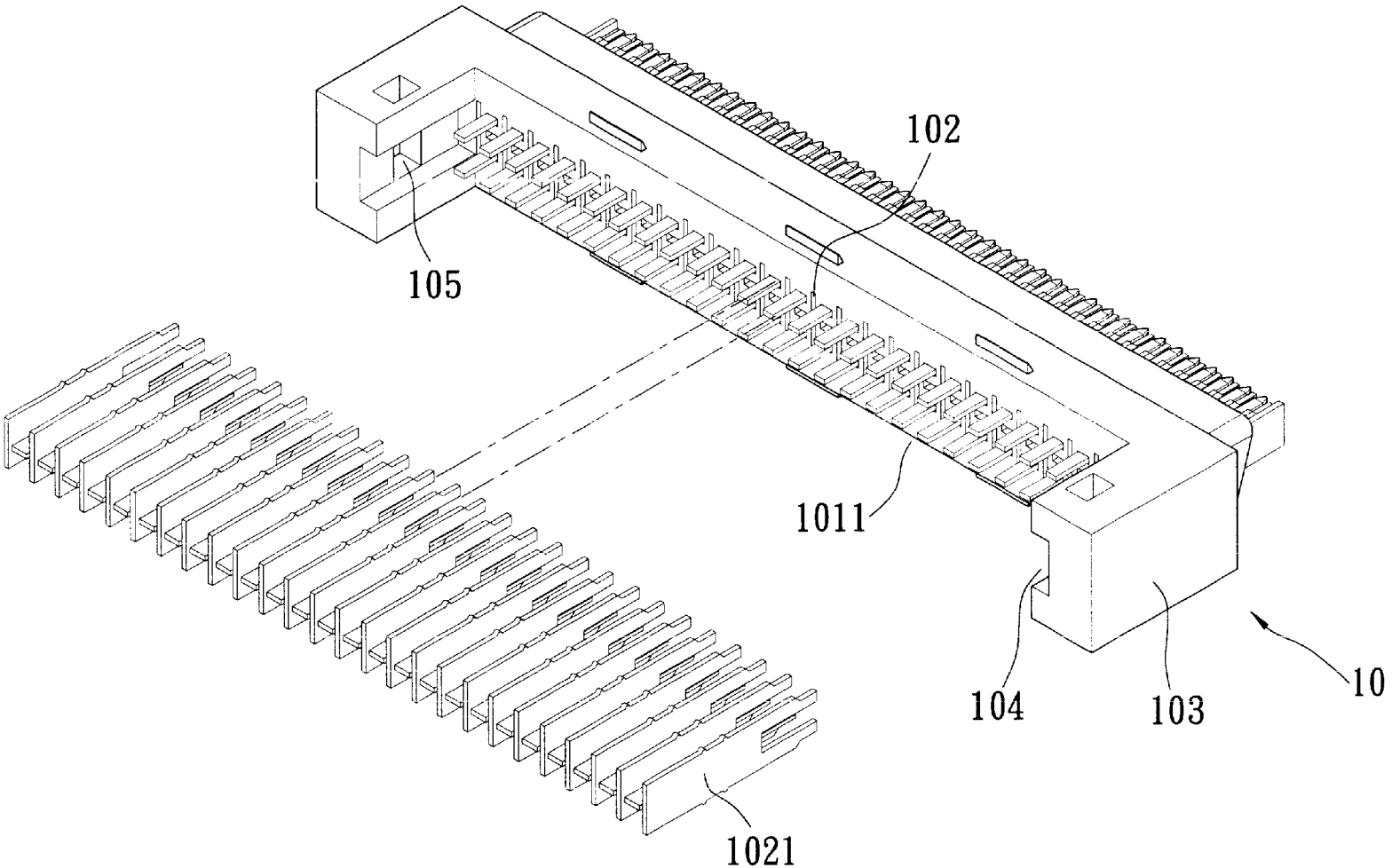
FIG. 8 shows the second step of assembling the connector of the present invention by inserting isolation plates into isolation slots provided on the plastic body of the connector.
Figure 9:
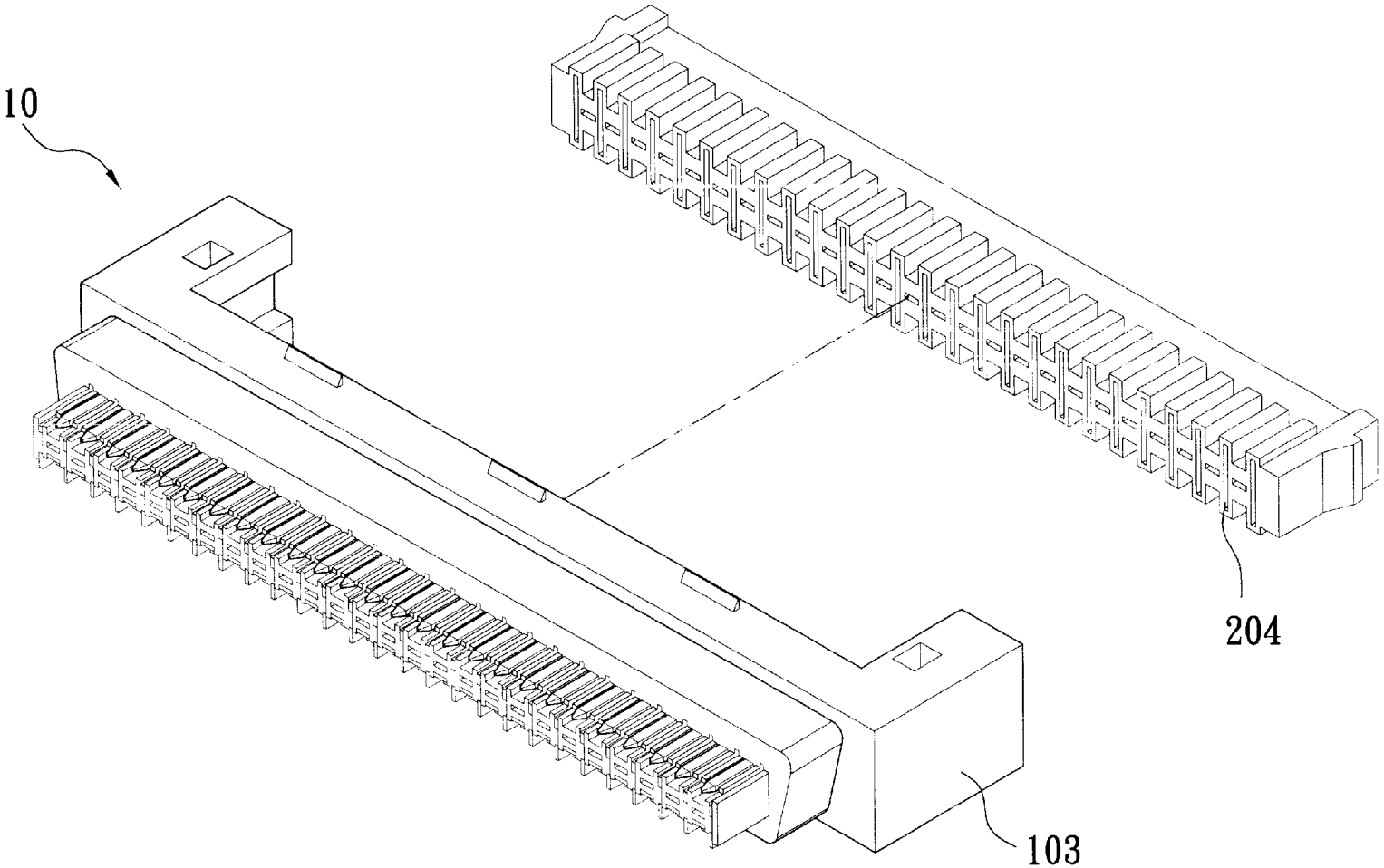
FIG. 9 shows the third step of assembling the connector of the present invention by connecting an insertion plate to the plastic body of the connector.

The plastic body 10 is provided at the rear side with upper and lower rows of correspondingly arranged terminal slots 101, into each of which a terminal 1011 is inserted, as shown in FIG. 7. A horizontal isolation slot 102 is provided between each upper terminal slot 101 and a corresponding lower terminal slot 101, and a vertical isolation slot 102 is provided between any two adjacent pairs of upper and lower terminal slots 101, such that the horizontal and the vertical isolation slots 102 are transversely and sequentially arranged across the rear side of the plastic body 10 like a series of letters H. Each of the isolation slots 102 receives a front part of an isolation plate 1021 therein, as shown in FIG. 8. The plastic body 10 includes two rearward extended lateral walls 103, inner surfaces of which are provided with horizontally extended guide slots 104. And, two retaining holes 105 are separately formed in the guide slots 104 at predetermined positions for holding the insertion plate 20 to the rear side of the plastic body 10, as shown in FIG. 9.

The insertion plate 20 is provided at two lateral ends with two retaining projections 202 for engaging with the retaining holes 105 in the guide slots 104 of the plastic body 10, and at upper and lower surfaces with a plurality of spacing ribs 201. Any two adjacent spacing ribs 201 define a recess 203 between them for receiving a rear end of one corresponding terminal 1011, a front end of which has been inserted into the terminal slot 101 on the plastic body 10. Please refer to FIG. 9. The insertion plate 20 is provided at a front side facing toward the rear side of the plastic body 10 with a plurality of alternately arranged horizontal and vertical isolation slots 204 corresponding to the isolation plates 1021 inserted into the plastic body 10, such that the alternate horizontal and the vertical isolation slots 204 look like a series of letters H.

Figure 11:
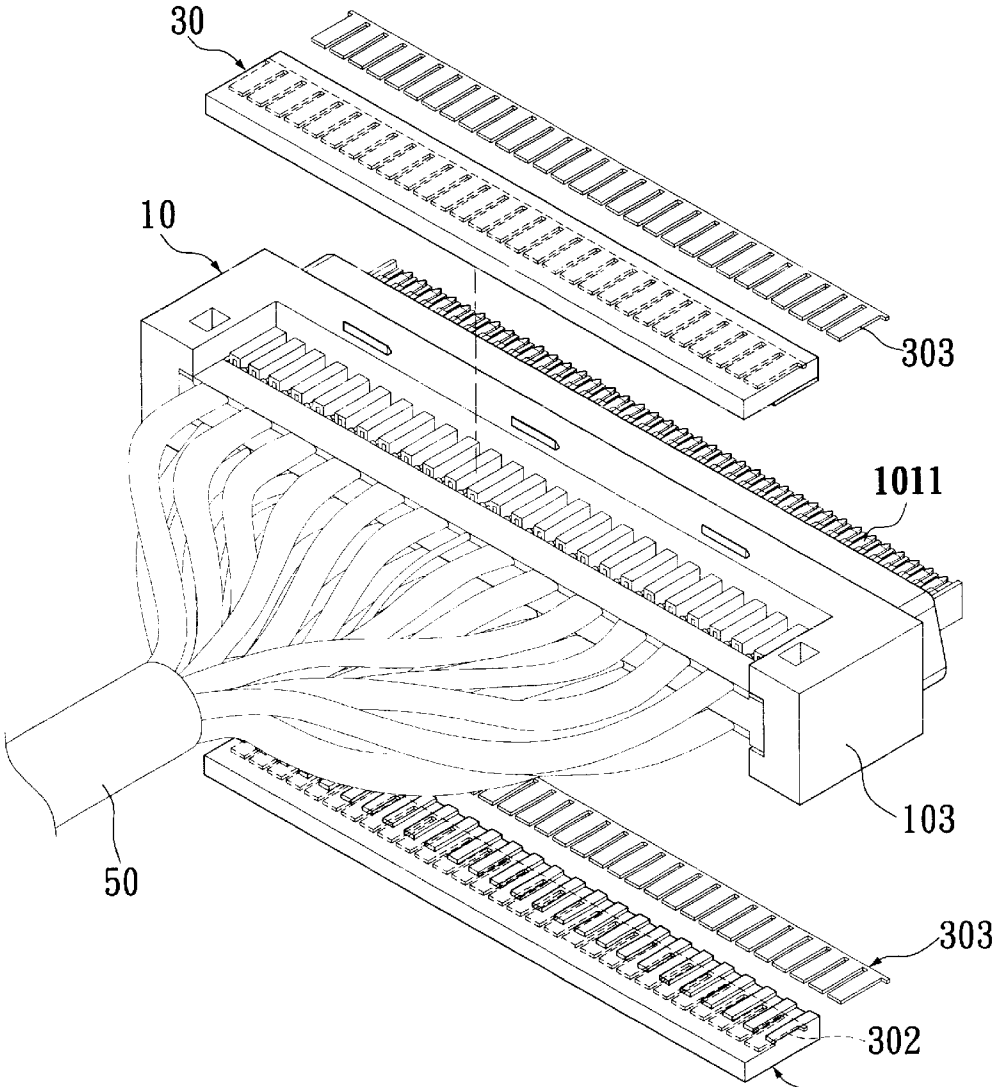
FIG. 11 shows the fifth step of assembling the connector of the present invention by covering two hold-down plates onto upper and lower sides of the plastic body of the connector to complete the assembling.

Please refer to FIG. 11. Each of the covering plates 30 is provided at a front part of one side facing toward the upper or the lower surface of the insertion plate 20 with a plurality of raised pressed ribs 301 corresponding to the isolation ribs 201 of the insertion plate 20, so that the covering plates 30 are covered onto upper and lower sides of the insertion plate 20 with the pressed ribs 301 abutting on tops of the isolation ribs 201. The covering plate 30 is also provided at a front side with a plurality of isolation slots 302, such that the isolation slots 302 are separately located between and below two adjacent pressed ribs 301 for receiving a row of flat isolation plates 303 therein. FIG. 11 shows, using dashed lines, the isolation plates 303 being received within the slots 302 so that the plates 303 are below the pressed ribs 301. After the interconnecting cable 50 and the terminals 1011 are connected together, the pressed ribs 301 of the covering plates 30 are integrally connected to the tops of the spacing ribs 201 of the insertion plate 20 by way of high-frequency heat sealing.

Figure 10:
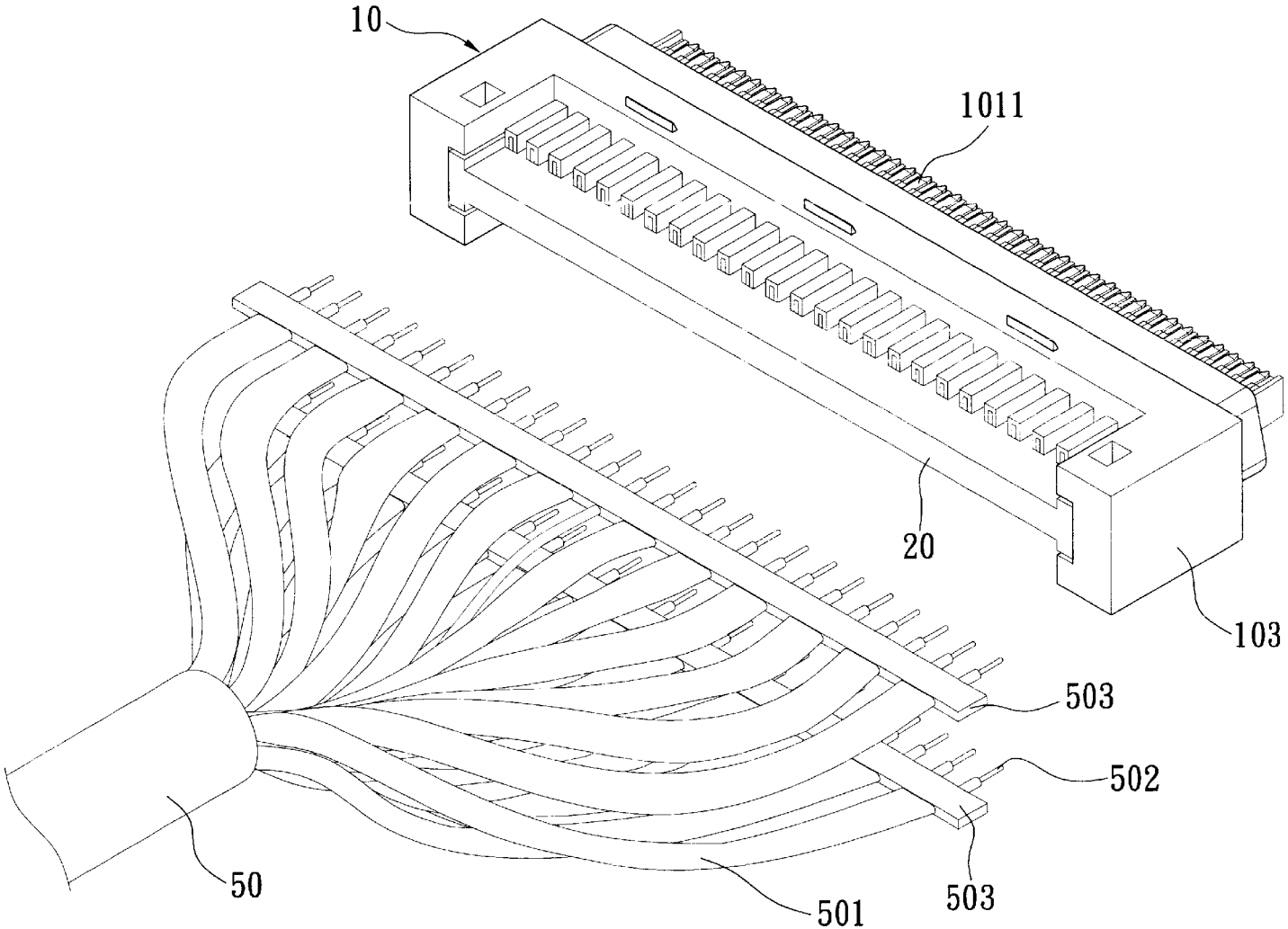
FIG. 10 shows the fourth step of assembling the connector of the present invention by connecting an interconnecting cable to the plastic body of the connector.

Please refer to FIG. 10. The interconnecting cable 50 includes a plurality of conducting wires 501 that are previously arranged into two rows corresponding to the terminals 1011 in the upper and the lower row of terminal slots 101, and then held in place with two horizontally extended clamp plates 503. Front ends of the conducting wires 501 are projected from a front side of the clamp plates 503 to expose a fixed length of bare wires 502 for connecting to the terminals 1011 by way of soldering.

Figure 12:
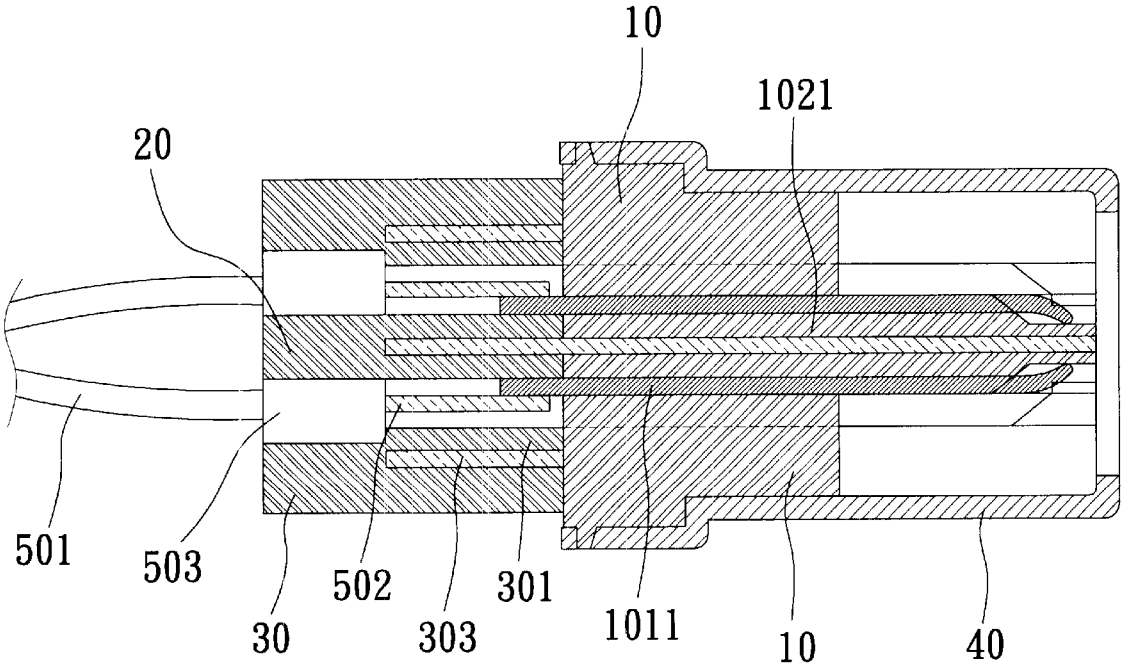
FIG. 12 is a sectional view taken along line A—A of FIG. 6.

To assemble the connector of the present invention, the insertion plate 20 is slid into the plastic body 10 via the guide slots 104, and the two clamp plates 503 of the interconnecting cable 50 are separately set onto upper and lower sides of the insertion plate 20, so that every conducting wire 501 is located in a corresponding recess 203 between two adjacent spacing ribs 201. This allows the bare wire 502 of every conducting wire 501 to be soldered to the rear end of the corresponding terminal 1011. Thereafter, the two covering plates 30 are positioned to cover upper and lower sides of the insertion plate 20 with the pressed ribs 301 abutted against the spacing ribs 201. Finally, the pressed ribs 301 and the spacing ribs 201 are connected together by way of high-frequency heat sealing, and e the steel case 40 is placed onto the front side of the plastic body 10 to complete the connector. FIG. 12 is a sectional view taken along line A—A of FIG. 6 showing the assembled connector of the present invention.

Figure 13:
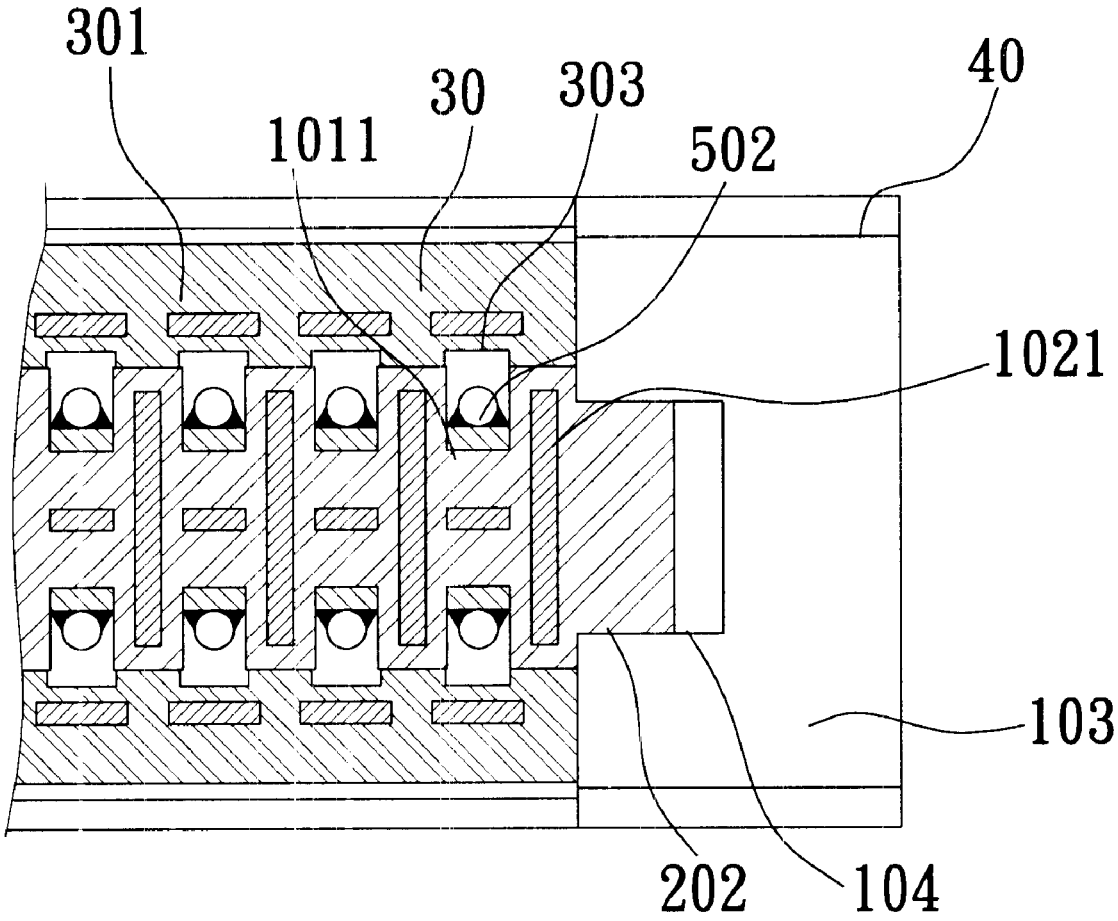
FIG. 13 is a sectional view taken along line B—B of FIG. 6.

FIG. 13 is a fragmentary sectional view taken along line B—B of FIG. 6. As can be seen in FIG. 13, in the assembled connector, the isolation plates 1021 and 303 provide a plurality of isolation layers to surround the terminals 1011, so that every terminal 1011 is individually isolated. The individually isolated terminals 1011 do not mutually interfere with one another during transmission of signals at extremely high speed, so that the signals are transmitted faster and more stably.

The present invention has been described with a preferred embodiment thereof and it is understood that many changes and modifications in the described embodiment can be carried out without departing from the scope and the spirit of the invention as defined by the appended claims.

What is claimed is:

1. A connector, comprising:

a plastic body having a plurality of upper and lower terminal slots arranged in a predetermined manner, each of said terminal slots receiving a terminal therein, said plastic body also having a plurality of horizontal and vertical first isolation slots, each of said horizontal first isolation slots being provided between one of said upper terminal slots and a corresponding one of said lower terminal slots, and each of said vertical isolation slots being provided between any two adjacent pairs of said upper and said lower terminal slots;

a first isolation plate having a front part received within said horizontal and vertical first isolation slots wherein said first isolation plate is configured to appear as a series of H-shaped plates;

a metal case positioned over an outer portion of a front side of said plastic body;

an insertion plate connected to a rear side of said plastic body, said insertion plate having an upper and a lower surface, each of said upper and said lower surfaces of said insertion plate being provided with a plurality of spacing ribs, and a plurality of recesses, with each recess being defined between two adjacent ones of said spacing ribs, each said recess of said insertion plate separately receiving a rear end of a respective terminal therein, said insertion plate being provided at a front side facing toward said rear side of said plastic body with a plurality of horizontal and vertical second isolation slots disposed in alignment with said horizontal and vertical first isolation slots, and receiving a rear part of said first isolation plate therein;

an interconnecting cable including two rows of conducting wires, each wire being separately positioned in a rear of each respective recess of said insertion plate for electrical coupling with a respective terminal;

two covering plates separately covering said upper and lower surfaces of said insertion plate to hold said conducting wires of said interconnecting cable in place, each of said covering plates being provided with a plurality of third isolation slots, and each having at a side facing toward said insertion plate a plurality of pressed ribs corresponding to and adapted to be integrally connected to tops of said spacing ribs on said insertion plate, each said third isolation slot being disposed between two adjacent pressed ribs; and a second isolation plate received within said third isolation slots, such that said second isolation plate and said first isolation plate together provide an isolation layer that surrounds four sides of each said terminal located in each said recess of said insertion plate;

whereby said terminals are individually isolated from each other without mutually interfering with one another during high speed transmission of signals, enabling signals to be transmitted faster and more stably.

2. The connector as claimed in claim 1, wherein said second isolation slots in said insertion plate are arranged to appear as a series of H-shaped slots.

3. The connector as claimed in claim 1, wherein said second isolation plate has an appearance of a series of flat, horizontal dashes.

* * * * *